US007007744B2

(12) United States Patent
Kalbacher

(10) Patent No.: US 7,007,744 B2
(45) Date of Patent: Mar. 7, 2006

(54) MOUNT FOR FAN SHROUD ON HEAT EXCHANGER

(75) Inventor: Klaus Kalbacher, Rangendingen (DE)

(73) Assignee: Modine Manufacturing Company, Racine, WI (US)

( * ) Notice: Subject to any disclaimer, the term of this patent is extended or adjusted under 35 U.S.C. 154(b) by 164 days.

(21) Appl. No.: 10/784,567

(22) Filed: Feb. 23, 2004

(65) Prior Publication Data

US 2004/0250987 A1 Dec. 16, 2004

(30) Foreign Application Priority Data

Feb. 21, 2003 (DE) ..... 103 07 488

(51) Int. Cl.
*F28F 9/007* (2006.01)

(52) U.S. Cl. ..... 165/67; 165/121; 24/615; 123/41.49; 180/68.1; 248/225.11

(58) Field of Classification Search ..... 165/67, 165/121, 122; 24/615, 616; 248/225.11, 248/225.21, 224.7, 222.13; 123/41.49; 180/68.1, 180/68.4
See application file for complete search history.

(56) References Cited

U.S. PATENT DOCUMENTS 3,947,932 A * 4/1976 Flynn ..... 24/616
4,282,634 A * 8/1981 Krauss ..... 24/323
5,086,547 A * 2/1992 Ziemelis ..... 24/615
5,219,016 A * 6/1993 Bolton et al. ..... 165/67
5,263,234 A * 11/1993 Fudaki ..... 24/662
5,522,457 A * 6/1996 Lenz ..... 165/121
5,704,418 A * 1/1998 Baader et al. ..... 165/121
6,315,034 B1 * 11/2001 Mahe et al. ..... 165/121
6,615,460 B1 * 9/2003 Baumgarten ..... 24/615
6,904,958 B1 * 6/2005 Ozaki et al. ..... 165/67

FOREIGN PATENT DOCUMENTS

EP 219021 A2 * 4/1987
JP 2002004861 A * 1/2002
JP 2002098113 A * 4/2002
JP 2002147985 A * 5/2002

* cited by examiner

*Primary Examiner*—Leonard R. Leo
(74) *Attorney, Agent, or Firm*—Wood, Phillips, Katz, Clark & Mortimer

(57) ABSTRACT

A fastening between a fan shroud and a heat exchanger, the fastening including a plurality of cooperating fastening devices about the outer edge of the shroud and heat exchanger. At least one of the cooperating fastening devices comprises a locking hook on one edge of the shroud, a mount on an edge of the heat exchanger corresponding to the shroud one edge, a stop on the corresponding heat exchanger edge spaced from the mount slot in a direction opposite a first direction, and an elastically flexible extension on the locking hook including a locking tab. The mount defines a slot adapted to receive the locking hook from the first direction. The extension is elastically biased toward an interfering position between the locking tab and the stop when the locking hook is received in the mount slot, and is manually engageable to flex the extension to a releasing position in which the locking tab does not interfere with the stop.

12 Claims, 4 Drawing Sheets

MOUNT FOR FAN SHROUD ON HEAT EXCHANGER

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward fan assisted heat exchangers, and particularly toward fastening structures for mounting fan shrouds to heat exchangers.

BACKGROUND OF THE INVENTION AND TECHNICAL PROBLEMS POSED BY THE PRIOR ART

Heat exchangers such as vehicle radiators having tubes extending between headers/collecting tanks and plate or serpentine fins are well known. In many applications, such heat exchangers are fan assisted whereby a fan may force air over heat exchange surfaces (e.g., the tube walls and fins) to facilitate heat transfer between the air and coolant or other fluid in the tubes.

In many such applications, a fan shroud is provided to assist in guiding the fan air over the heat exchange surfaces. Secure and reliable fastening or mounting of the fan shroud relative to the heat exchanger is, of course, important, as is the ability to assemble and, perhaps years later, disassemble such a fastening.

For example, one known radiator of the type just described is apparent from DE 42 44 037 C2, in which fastening devices on the edge of the fan shroud cooperate with fastening devices on the collecting tanks of the heat exchanger. Although assembly of the fan shroud in the known radiator is also possible when the radiator is also incorporated in a vehicle, disassembly of the fan shroud is difficult, since a tool must be used to loosen the elastic locking hooks molded onto the two collecting tanks to the heat exchanger in order to be able to free them from their locked position. Moreover, it appears that, with a radiator having standard dimensions, it would be difficult for a single assembly person to loosen both locking hooks simultaneously, such loosening being necessary to disassemble the fan shroud. In addition, the arms which run from the frame to the edge of the fan shroud occupy the housing in the vehicle (where space is very limited anyway). Still further, the arms pose a certain risk of injury to the assembly person, especially if they are not carefully deburred.

A U-shaped housing is also proposed in DE 100 61 561 A1 or in WO 99/47875. One or more heat exchangers are positioned in the housing, and fastening devices which cooperate with fastening devices on the edge of the fan shroud are arranged in the housing. The housing depicted there has a cross arm as a single part that is mounted between the two free arms of the frame, in order to give the housing the necessary rigidity.

The present invention is directed toward overcoming one or more of the problems set forth above.

SUMMARY OF THE INVENTION

In one aspect of the present invention, a fastening between a fan shroud and a heat exchanger is provided. The fastening includes a plurality of cooperating fastening devices about the outer edge of the shroud and heat exchanger. At least one of the cooperating fastening devices comprises a locking hook on one edge of the shroud, a mount on an edge of the heat exchanger corresponding to the shroud one edge, a stop on the corresponding heat exchanger edge spaced from the mount slot in a direction opposite a first direction, and an elastically flexible extension on the locking hook including a locking tab. The mount defines a slot adapted to receive the locking hook from the first direction. The extension is elastically biased toward an interfering position between the locking tab and the stop when the locking hook is received in the mount slot, and is manually engageable to flex the extension to a releasing position in which the locking tab does not interfere with the stop.

In one form of this aspect of the present invention, a housing is provided about the edge of the heat exchanger, wherein the mount is on the housing.

In another form of this aspect of the present invention, the fastening mounts the fan shroud to the front of the heat exchanger, the first direction is generally up and the mount slot is upwardly open and spaced forwardly of the front of the heat exchanger at the corresponding heat exchanger edge, and the locking hook extends laterally from the shroud one edge.

In a further form, the mount includes a front leg spaced forwardly of a rear leg with the mount slot defined between the legs, and the locking hook includes a lower portion having two arms spaced from the lower portion on opposite sides thereof, the lower portion being receivable between the front and rear legs with the front leg captured between the lower portion and two arms. In one further form, the mount front leg has a tapered upper surface adapted to guide the locking hook toward the heat exchanger when the locking hook is moved down into the mount slot. In a still further form, a continuation on the locking hook is substantially vertically aligned with the locking tab on a side of the locking hook opposite the locking tab, wherein the continuation extends to the mount front leg when the locking hook is received in the mount slot to secure the locking hook against unintended loosening.

In yet another form of this aspect of the invention, the first direction is generally up and the stop is spaced above the mount slot. In a further form, the stop has a tapered upper surface adapted to flex the locking hook extension past the stop when the locking hook is moved into the mount slot.

In still another form of this aspect of the invention, at least one other of the cooperating fastening devices comprise a pin and hook.

In another form, the fan shroud is plastic and the locking hook is a protrusion molded on the one edge of the shroud.

In yet another form, the heat exchanger is a heat exchanging device and a housing supporting the heat exchanging device in an installation.

In still another form, the first direction is generally up, and the stop secures the one cooperating fastening device against separation due to relative vertical movement.

DETAILED DESCRIPTION OF THE INVENTION

Figure 1:
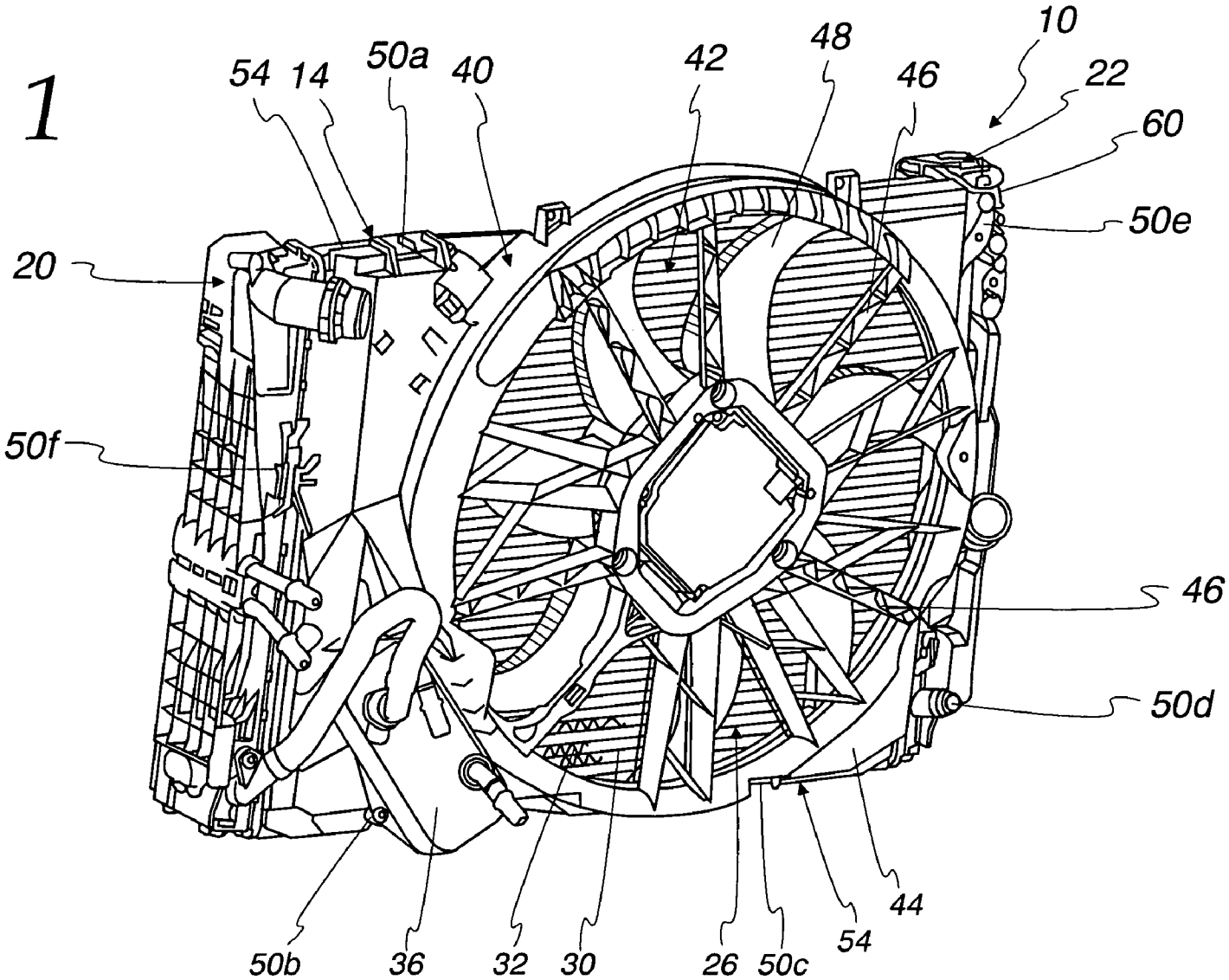
FIG. 1 is a perspective view of a heat exchanger with a fan shroud mounted thereon according to the present invention.

A heat exchanging structure 10 in which the present invention is embodied is illustrated in FIG. 1. The structure 10 includes a heat exchanger 14 (such as a crossflow cooler) having collecting tanks or headers 20, 22 arranged vertically on opposite sides of the heat exchanger 14, with a suitable core 26 extending therebetween. The core 26 may include a plurality of flat tubes 30 with suitable ribs 32 arranged in between (only some of which are shown in FIG. 1).

The tubes 30 and ribs 32 may be of any suitable design according to the requirements of the structure 10 including, for example, round or flat tubes and/or serpentine or plate fins. Further, the heat exchanger 14 may be of any suitable material including, for example, plastic collecting tanks 20, 22. Moreover, it should be recognized that the heat exchanger 14 with which the present invention may be used may be of virtually any suitable heat exchanging configuration.

In the illustrated embodiment, an oil cooler 36 is also shown, and may be provided, for example, to cool transmission oil by means of the circulating coolant of the internal combustion engine (not shown).

A fan shroud 40 made, for example, of plastic is secured in front of the heat exchanger 14 (i.e., when used in a vehicle, in front of the heat exchanger 14 relative to the direction of travel of the vehicle). The fan shroud 40 has a central opening 42 surrounded by a frame 44. Reinforcing supports 46 may also be provided from the frame 44 to the central opening 44 in stellate fashion.

A driven fan 48 may be mounted in the central opening 42 in a suitable manner. The fan 48 draws in cooling air during operation through the core 26 of the heat exchanger 14, whereby heat from a fluid within the heat exchanger tubes 30 may be exchanged/discharged to the air passing over the tube outer walls and fins 32. When used with a vehicle, the cooling air is blown through the heat exchanger 14 in the direction of the engine compartment, where the cooling air can also be used for additional cooling purposes, and then taken off.

The oil cooler 36 may also be suitably fastened to the fan shroud 40.

In accordance with the present invention, different cooperating fasteners 50 may be advantageously provided around the perimeter of the heat exchanging structure 10 for securing the fan shroud 40 to the heat exchanger 14. That is, as illustrated in FIG. 1, cooperating fasteners 50*a–c* are provided between end plates 54 at the top and bottom of the heat exchanger 14 and the upper and lower portions of the shroud frame 44. Further, cooperating fasteners 50*d–f* are provided between the collecting tanks 20, 22 and the side portions of the shroud frame 44.

It should be appreciated that fastener components secured to plastic components, such as those fasteners components on plastic collecting tanks 20, 22 and/or a plastic fan shroud 40, may be integrally molded with such components so as to consist of a plastic material having a degree of elasticity. It should also be appreciated that the number of fasteners 50*a–f* provided for securing the shroud 40 to the heat exchanger 14 may vary depending on a variety of factors, and that the present invention is not limited to a specific number of such fasteners 50.

A number of the fasteners 50*d–e* may consist of an upwardly facing hook-like support formed, for example, on the collecting tanks 20, 22 which cooperate with tappet-like protrusions formed on the edge of the fan shroud 40, whereby the tappet-like protrusions may be lowered into the cooperating hook-like supports when mounting the fan shroud 40 to the heat exchanger 14. Further, the supports and/or protrusions may be advantageously designed so that tolerances between the heat exchanger 14 and the fan shroud 40 can be compensated.

A locking fastener 60 may also be advantageously provided at an opening (not shown) in one or more of the fasteners 50*e* on the fan shroud 40 and a blind hole (not shown) in the collecting tank 22. The fastener 60 may advantageously be located at an accessible site, such as the upper portion of the heat exchanger 14, so that it can, in the case of disassembly, be readily accessed and removed with a single hand motion.

The already mentioned upper fasteners 50*a* may be, for example, hooks that extend over the edge of the upper end plate 54, and the lower fasteners 50*b–c* may be pins on the edge of the fan shroud 40 that are inserted into matching slits in the lower end plate 54. The upper fasteners 50*a* may be arranged somewhat closer to the collecting tanks 20 or 22 than the lower fasteners 50*b–c*.

Figure 2:
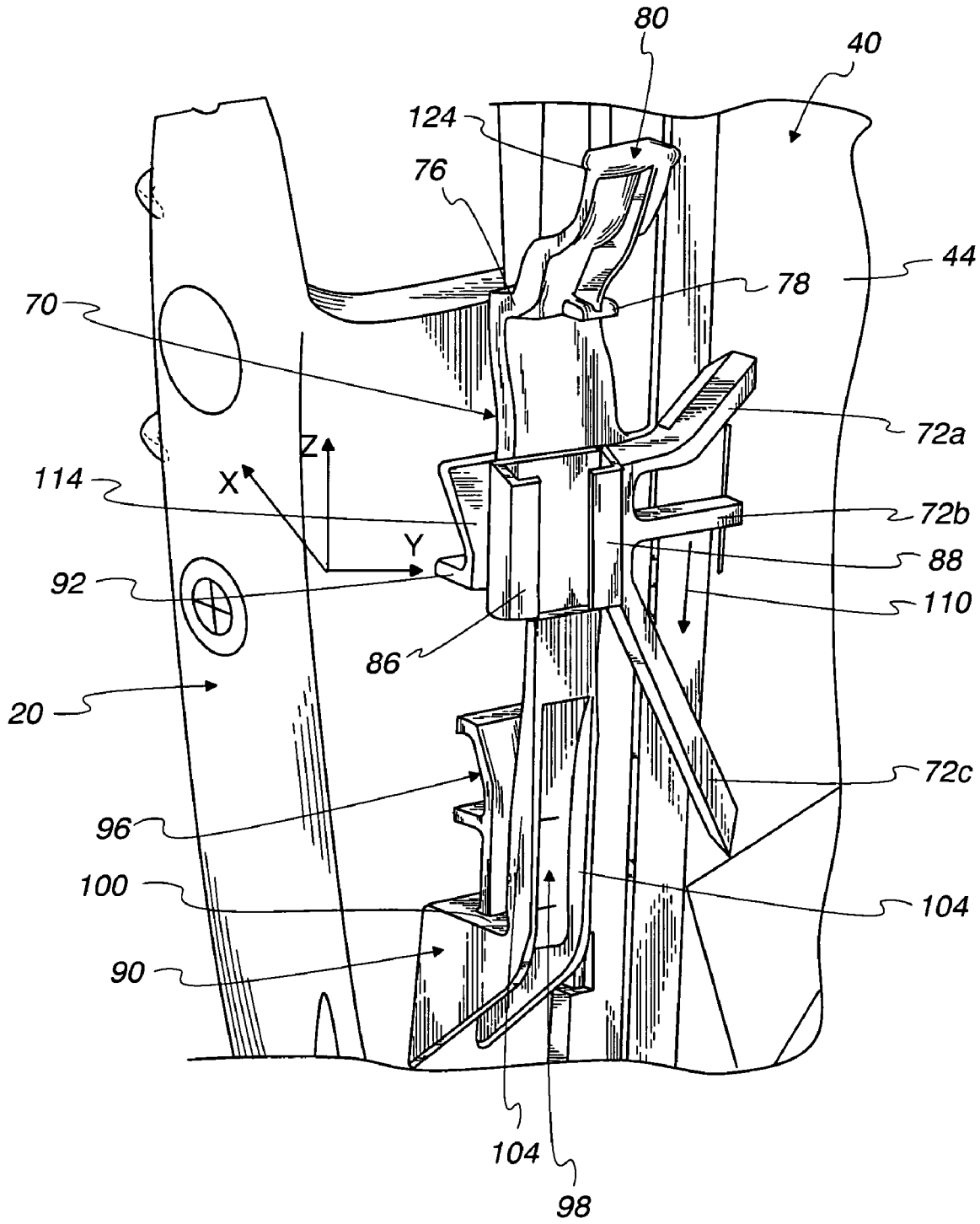
FIG. 2 is an enlarged perspective view showing the locking hook of FIG. 1 when disassembled.
Figure 3:
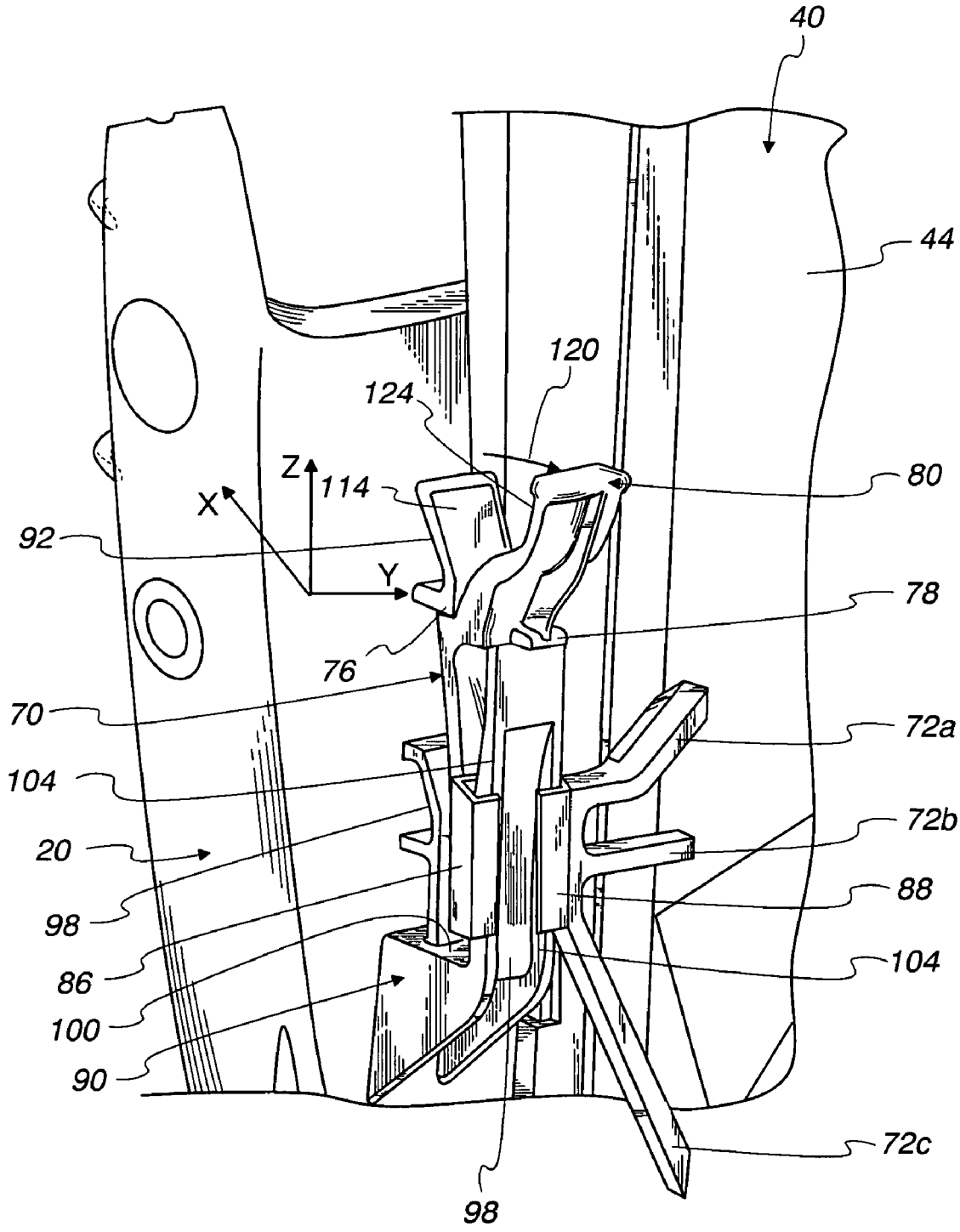
FIG. 3 is an enlarged perspective view showing the locking hook of FIG. 1 when the shroud is assembled on the heat exchanger.

FIGS. 2–3 illustrate details of the fastener 50*f* between the left edge of the fan shroud 40 and the left collecting tank 20.

Specifically, a locking hook 70 is suitably supported on the fan shroud 40, as by three protruding molded legs 72*a–c*. The locking hook 70 includes a locking tab 76 facing in the X direction and, at about the same height (Z direction), has a rib 78 extending in the opposite direction. Above the height of the locking tab 76 is a manually engageable extension 80 which may be used to loosen the locking hook 70 as described further below.

Beneath the locking tab 76, the locking hook 70 may be advantageously formed in the shape of a "U" or a "C" with two arms 86, 88 on opposite sides of the locking hook 70. As illustrated in FIGS. 2–3, the arms 86, 88 form a "C" as viewed from above.

The fastener 50*f* on collecting tank 20 consist of a mount 90 for the locking hook 70 and a stop 92, which may be advantageously molded integrally with the collecting tank 20 when made of plastic. The mount 90 consists of two legs 96, 98 projecting upwardly from a bottom 100, with suitable support ribs 104 thereon.

During mounting of the fan shroud 40, it is pushed in the direction of the arrow 110 in FIG. 2 (i.e., downward along the Z axis). As the locking hook 70 moves down, the two arms 86, 88 of the locking hook 70 first enclose the front leg 98 of the mount 90. Further, the locking hook 70 beneath its locking tab 76 engages the upper, tapered portion 114 of the stop 92, causing the locking hook 70 to flex forwardly (away from the stop 92) until, in the final position, the bottom of the locking hook 70 is limited by the mount bottom 100. In that position, the locking tab 76 is beneath the stop 92, and the locking tab 76 elastically flexes back to its original position, in which case it lies beneath the bottom of the stop 92 and is therefore blocked from being raised up out of the fastened position. Further, the interengagement of the locking hook 70 between the legs 96, 98 and the leg 98 between the locking hook arms 86, 88 may preferably have only limited play to ensure a secure fastening of the fan shroud 40 to the collecting tank 20. Moreover, undesirable loosening of the fan shroud 40 (e.g., under the influence of vibrations during operation) is prevented.

It should also be appreciated that the upper end of the front leg 98 is advantageously tapered, so as to facilitate initial movement of the locking hook 70 onto the mount 90, and further to permit manual pivoting of the locking hook extension 80 to clear the locking tab 76 from beneath the stop 92 to allow the fan shroud 40 to be moved up to disengage it from the cooling tank 20 (e.g., during disassembly or maintenance). That is, if the fan shroud 40 is to be disassembled, a pressure force may be exerted on the locking hook extension 80 in the direction of the arrow 120 in FIG. 3, whereupon the locking tab 76 is released and the fan shroud 40 can be lifted up clear of the locking hook 70, supported by continued grasping of the extension 80. Such a procedure may be advantageously performed without a tool. The end of the extension 80 may therefore advantageously be formed with a cavity 124 for manual handling with a finger.

Moreover, the fastener 50*f* such as described may be advantageously configured so as to be the only fastener which locks the fan shroud 40 to the heat exchanger 14, whereby the other fasteners may freely release the shroud 40 when lifted. Accordingly, the shroud 40 may be securely maintained on the heat exchanger 14 and yet may also be easily removed when necessary for disassembly or maintenance. That is, by locating the fastener 50*f* as illustrated, the shroud 40 may be readily disassembled by a single person, without using any tool, by pressure on the locking hook extension 80 and removing the fan shroud 40 upward. Further, this enables the shroud 40 to be securely mounted with a minimal number of fasteners.

Figure 4:
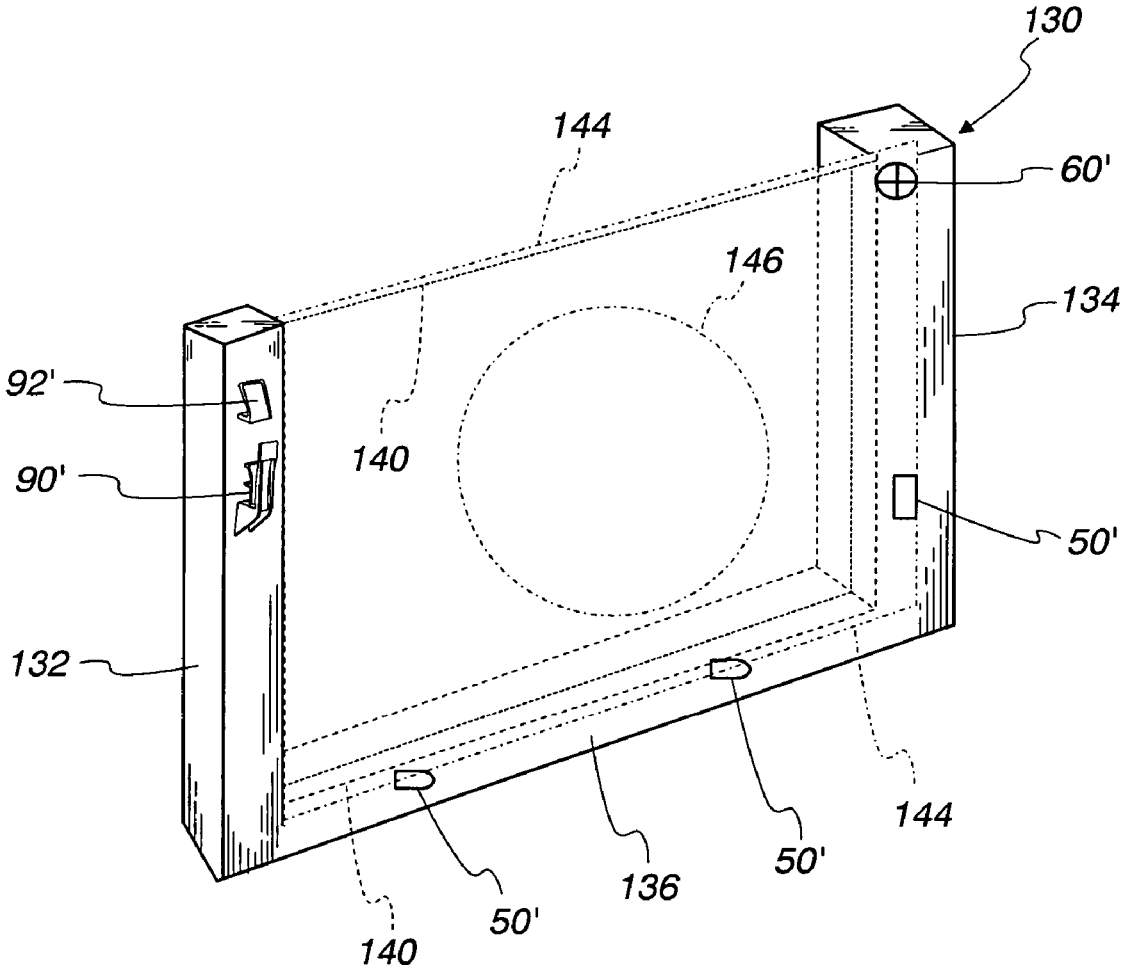
FIG. 4 is a simplified perspective view of a second embodiment of the invention in which a housing supports the heat exchanger with a fan shroud mounted to the housing according to the present invention.

FIG. 4 shows the principle of another practical example of the present invention in which a housing 130 (which can consist of, e.g., metal or plastic) having suitable supports with damping elements to support a heat exchanger (e.g., the radiator of a vehicle, not shown). The housing 130 has two ends 132 and 134 and a lower crosspiece 136 connecting them. Heat exchangers may be inserted and fastened in the housing 130 in a suitable manner (not shown) including, as is frequently desired, several heat exchangers arranged one behind the other in the direction of cooling air flow. The periphery of an exemplary heat exchanger is shown by the dotted line 140, and the edge of a fan shroud according to the present invention and its central opening are marked with a dash-dot line 144, 146. Suitable fasteners 50' and a locking fastener 60' such as previously described may be spaced around the periphery of the housing 130, as may a fastener such as shown in FIGS. 2–3 (with the mount 90' and stop 92' arranged on the left end 132 of the housing 130 and cooperable with a fan shroud locking hook such as previously described). It should be appreciated that a fan shroud such as previously described may advantageously imparts desired rigidity to the housing 130 so that, in contrast to the prior art, an upper crosspiece need not be provided between the ends 132, 134.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

What is claimed is:

1. A fastening between a fan shroud and a heat exchanger, said fastening comprising a plurality of cooperating fastening devices about the outer edge of said shroud and heat exchanger, at least one of said cooperating fastening devices comprising:

a locking hook on one edge of said shroud;

a mount on an edge of said heat exchanger corresponding to said shroud one edge, said mount defining a slot adapted to receive said locking hook from a first direction;

a stop on said corresponding heat exchanger edge spaced from said mount slot in a direction opposite said first direction; and an elastically flexible extension on said locking hook including a locking tab, said extension being elastically biased toward an interfering position between said locking tab and said stop when said locking hook is received in said mount slot, and manually engageable to flex the extension to a releasing position in which said locking tab does not interfere with said stop.

2. The fastening of claim 1, further comprising a housing about the edge of said heat exchanger, wherein said mount is on said housing.

3. The fastening of claim 1, wherein said fastening mounts said fan shroud to the front of said heat exchanger;

said first direction is generally up and said mount slot is upwardly open and spaced forwardly of the front of said heat exchanger at said corresponding heat exchanger edge; and said locking hook extends laterally from said shroud one edge.

4. The fastening of claim 3, wherein said mount includes a front leg spaced forwardly of a rear leg with said mount slot defined between said legs;

said locking hook includes a lower portion having two arms spaced from said lower portion on opposite sides thereof, said lower portion being receivable between said front and rear legs with said front leg captured between said lower portion and two arms.

5. The fastening of claim 4, wherein said mount front leg has a tapered upper surface adapted to guide said locking hook toward said heat exchanger when said locking hook is moved down into said mount slot.

6. The fastening of claim 4, further comprising a continuation on the locking hook substantially vertically aligned with said locking tab on a side of said locking hook opposite said locking tab, said continuation extending to said mount front leg when said locking hook is received in said mount slot to secure the locking hook against unintended loosening.

7. The fastening of claim 1, wherein said first direction is generally up and said stop is spaced above said mount slot.

8. The fastening of claim 7, wherein said stop has a tapered upper surface adapted to flex said locking hook extension past said stop when said locking hook is moved into said mount slot.

9. The fastening of claim 1, wherein at least one other of said cooperating fastening devices comprise a pin and hook.

10. The fastening of claim 1, wherein said fan shroud is plastic and said locking hook is a protrusion molded on said one edge of said shroud.

11. The fastening of claim 1, wherein said heat exchanger comprises a heat exchanging device and a housing supporting said heat exchanging device in an installation.

12. The fastening of claim 1, wherein said first direction is generally up, and said stop secures said one cooperating fastening device against separation due to relative vertical movement.

* * * * *